US008657931B2

(12) United States Patent
Short et al.

(10) Patent No.: US 8,657,931 B2
(45) Date of Patent: Feb. 25, 2014

(54) GEARBOX DEOILER WITH SYCHNRONIZER

(75) Inventors: Keith E. Short, Rockford, IL (US); Michael R. Blewett, Stillman Valley, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 14 days.

(21) Appl. No.: 13/211,842

(22) Filed: Aug. 17, 2011

(65) Prior Publication Data

US 2013/0042760 A1 Feb. 21, 2013

(51) Int. Cl.
*B01D 45/12* (2006.01)

(52) U.S. Cl.
USPC ..... 95/270; 55/408; 55/409; 55/418

(58) Field of Classification Search
USPC ..... 55/418, 385.1, 385.3, 400, 404–409, 55/DIG. 19, DIG. 30, 317
See application file for complete search history.

(56) References Cited

U.S. PATENT DOCUMENTS

| | | | | |
|---|---|---|---|---|
| 4,531,358 | A | 7/1985 | Smith | |
| 6,033,450 | A * | 3/2000 | Krul et al. | 55/345 |
| 7,309,308 | B2 | 12/2007 | Berger et al. | |
| 7,377,110 | B2 | 5/2008 | Sheridan et al. | |

FOREIGN PATENT DOCUMENTS

| | | | |
|---|---|---|---|
| DE | 10226695 | A1 | 12/2003 |
| DE | 102004045630 | A1 | 4/2006 |
| EP | 1582703 | A2 | 10/2005 |

OTHER PUBLICATIONS

European Search Report dated Nov. 22, 2012 for Application No. 12180755.6-2311.

* cited by examiner

*Primary Examiner* — Dung H Bui
(74) *Attorney, Agent, or Firm* — Cantor Colburn LLP

(57) ABSTRACT

A gearbox that includes an inlet configured to receive a mixture of air and oil from an external source and a deoiler. The deoiler includes a shaft including an outlet passage formed on an inner portion of the shaft, a separator unit coupled to and surrounding a portion of the shaft and including an inlet port, and a synchronizer including one or more blades and that is coupled to the shaft proximate the inlet port.

9 Claims, 3 Drawing Sheets

GEARBOX DEOILER WITH SYCHNRONIZER

BACKGROUND OF THE INVENTION

The present invention relates to gearboxes, and, in particular, to a deoiler portion of a gearbox.

A typical gas turbine engine for an aircraft is coupled to a shaft that drives other shafts via a connection to a gearbox. As the air flows through the gearbox housing, a certain amount of oil naturally becomes entrained in the air and it is desirable that this oil be separated from the air before the air is vented from the gearbox. In some cases, bearing compartments in the turbine are vented into the gearbox and increase the amount of oil in the air in the gearbox.

In order to separate the oil from the air, a deoiler is included in the gearbox. In general, the deoiler includes a separator unit that utilizes centrifugal forces to separate the heavier oil from the lighter air. In some cases, the deoiler includes a shaft on which the separator unit is attached and that include an outlet through which air can be exhausted to the environment.

When the engine is in operation driving the deoiler, pressure greater than atmospheric builds up within the gearbox and because of the high speed rotating gears within the gearbox, oil becomes entrained with the air in chamber. As mentioned above, oil can also be introduced from the bearing compartments due to air that leaks into the bearing compartments from the higher pressure sections of the engine (e.g., compressors and turbines). It is often desirable to minimize the pressure in the gearbox and bearing compartments to help balance the pressure forces on the seals to help avoid blowing engine lubricating oil out of the bearing compartments into the lower pressure sections of the compressor, or turbine. For this reason a low pressure drop across the deoiler in general and the separating unit in particular is usually desired as this pressure drop biases the bearing compartment and gearbox pressure upward. That is, if there is a large pressure drop across the separating unit, the pressure in the gearbox must be increased to drive air into it. It is also advantageous to minimize the size (envelope) and weight of the separating unit. However to achieve the desired pressure drop performance, the size is often increased beyond the size needed to obtain the desired air-oil separation.

BRIEF DESCRIPTION OF THE INVENTION

According to one embodiment, a gearbox that includes an inlet configured to receive a mixture of air and oil from an external source is disclosed. The gearbox also includes a deoiler that includes a shaft including an outlet passage formed on an inner portion of the shaft, a separator unit coupled to and surrounding a portion of the shaft and including an inlet port, and a synchronizer including one or more blades and that is coupled to the shaft proximate the inlet port.

According to another embodiment, a method for removing oil from a mixture of air and oil is disclosed. The method includes passing the mixture through a rotating separator unit coupled to a shaft to remove the oil from the air to create exhaust air; and before passing, accelerating the mixture in a rotational direction with a synchronizer coupled to the shaft and located proximate an inlet to the unit.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
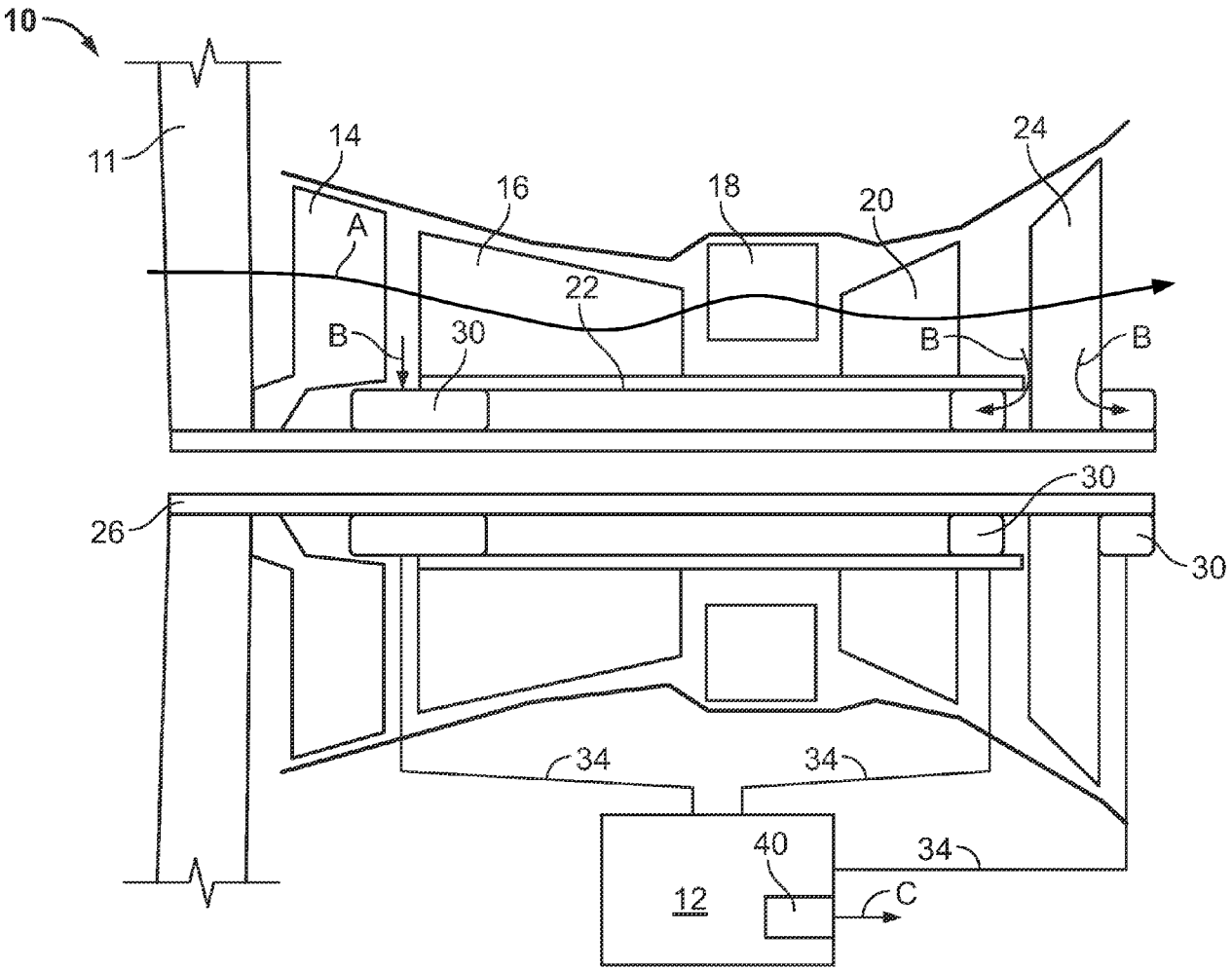
FIG. 1 is cut-away side view of an engine coupled to a gear box.

Referring now to FIG. 1, a simplified gas turbine engine 10 is illustrated coupled to a gear box 12. The gas turbine engine 10 includes causes air to generally travel in the direction shown by arrow A to generate thrust. In more detail, the gas turbine engine 10 includes a fan 11 that draws air into the gas turbine engine 10. The air is then compressed, in series, by a low 14 and high pressure 16 compressors. The compressed air is then mixed with fuel and burned in a combustor 18 to create a hot-gas flow that expands in a high pressure turbine 20 and causes the spool 22 to rotate. The spool 22 provides rotational force to the high pressure compressor 16. The hot-gas flow also drives a low pressure turbine 24 in order to rotate a central shaft 26 and provide rotation energy to, for example, the fan 11 and the low pressure compressor 14. It shall be understood that the gas turbine engine 10 illustrated in FIG. 1 is presented by way of example and the teachings herein can be applied to a gearbox attached to other types of engines or to any other source of rotational energy.

The central shaft 26 and/or the spool 22 can be coupled to one or more bearing compartments 30 as is known in the art. Pressurized air (indicated by arrows B) from the gas turbine engine 10 can enter the bearing compartments 30 and cause oil contained therein to be expelled into the gearbox 12. To that end, one or more air/fluid passages 34 can couple the bearing compartments 30 to the gearbox 12. It shall be understood by the skilled artisan that the gearbox 12 could also include a shaft (not shown) linked to the spool 22 or the central shaft 26 that provides rotational energy to the gearbox 12. This rotational energy can be used, for example, to drive a deoiler 40 included in the gearbox 12. In general, the deoiler 40 causes oil entrained in air in the gearbox 12 to be removed from the air as it is expelled from the gearbox 12 as indicated by arrow C.

Figure 2:
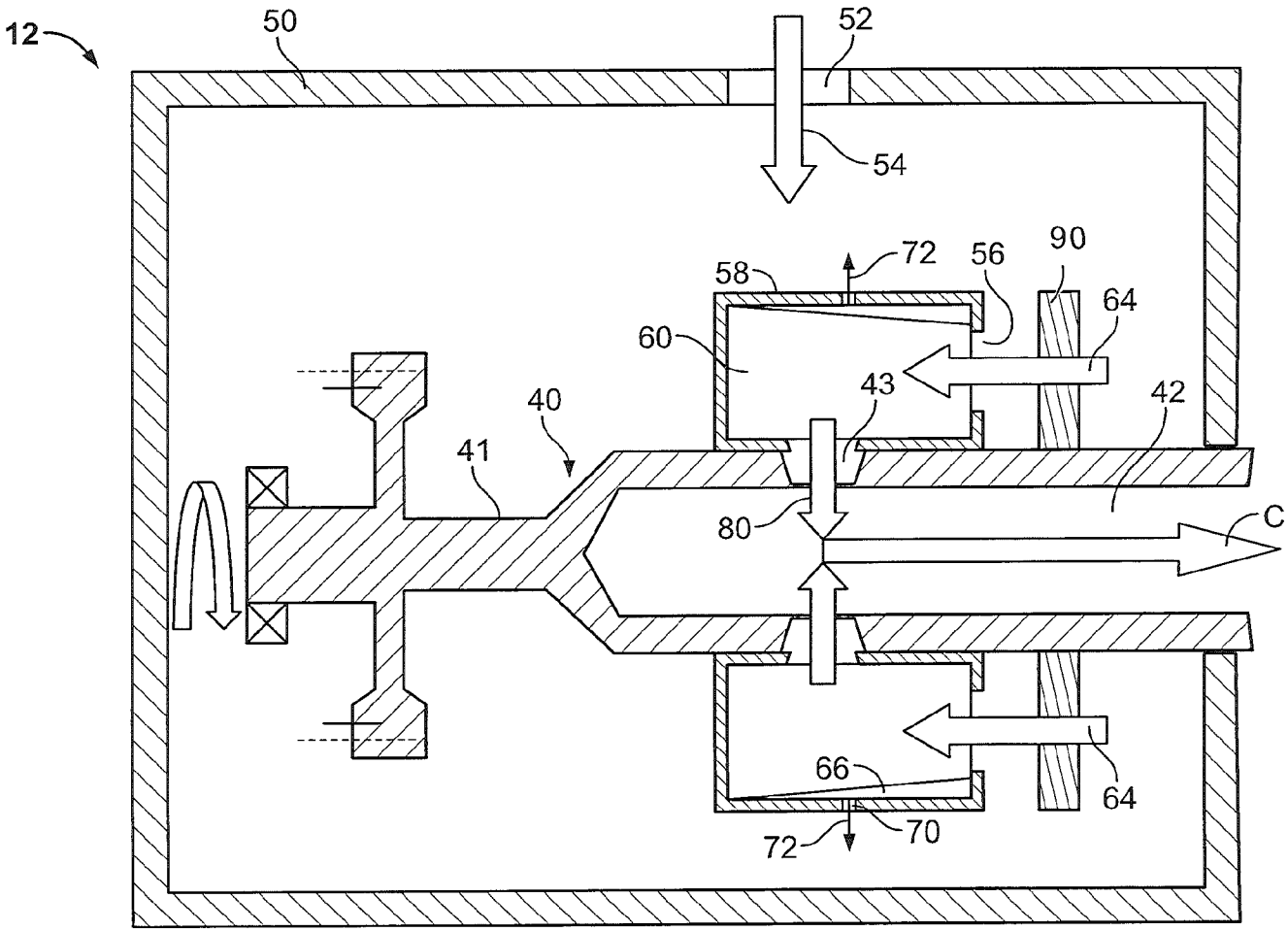
FIG. 2 is a partial cross sectional top-view of a gearbox.

FIG. 2 is a partial cross sectional top-view of gearbox 12 according to one embodiment. In this embodiment, the gearbox 12 includes a shell 50 that forms the outer boundaries of the gearbox 12. The shell 50 includes an inlet port 52 through which an air-oil mixture 54 can enter. The air-oil mixture 54 can be received, for example, from the bearing compartments 30 via air/fluid passages 34 as shown in FIG. 1. Of course, the air-oil mixture 54 could be received from any location and is not limited to being initiated in the bearing compartments 30. Indeed, in one embodiment, a mixture of air and oil can be created simply with oil found gearbox 12.

As previously described, the gearbox 12 can include a deoiler 40 that removes some or all of the oil from the air-oil mixture 54 and expels clean air as indicated by arrow C. While not illustrated, it shall be understood that the gearbox 12 is linked to the gas turbine engine 10 and receives rotational energy from it. The rotational energy can be used to drive the deoiler 40. In more detail, the deoiler 40 includes a shaft 41 that is driven by the rotational energy. The shaft 41 includes an outlet passage 42 formed on an interior portion thereof through which clean air (arrow C) is exhausted. A separator unit 58 is coupled to the shaft 41 and provides a path from a location within the gearbox 12 to the outlet passage 42. The separator unit 58 can include a separator media 60 such as a metal or other foam.

In operation, the air-oil mixture 54 and any other air/fluid mixture within the shell 50 of the gearbox 20 is drawn into the inlets ports 56 of the separator unit 58 of the deoiler 40. The air so drawn shall be referred to herein as inlet flow 64. The separator media 60 provides surfaces for oil particles in the inlet flow 64 to adhere to. The droplets of oil coalesce and the liquid is centrifugally slung to the outer diameter 66 of the separator unit 58 where it passes through drain holes 70 back into the gearbox 12 as is indicated by arrows 72. Air passes from an outside portion of the shaft 41 to the outlet passage 42 through one or more inner passages 43 surrounded by at least a portion of the separator unit 58.

The pressure drop from the inside of the gearbox 12 to the outlet passage 42 depends upon the flow geometry and the rotational speed of the separator unit 58. In particular, the geometry factors that influence pressure drop are ones that minimize the flow velocity (large flow area) and that allow gradual changes in flow direction and flow passage area. This avoids turbulence in the flow passages. To reduce the geometry related pressure drop usually means the separator unit 58 is made larger and heavier. The speed related pressure drop depends upon two things: the centrifugal pressure drop required to move air radially inward to the outlet passage 42 (arrows 80) in opposition to the centrifugal acceleration experienced by the oil. The second part of the pressure drop depends upon the flow loss associated with accelerating the inlet flow 64 up to the rotational speed of the separator unit 58. Tests have shown that this second part of the pressure drop (e.g., flow loss) is usually larger than the centrifugal pressure drop. As such, according to one embodiment, it may be advantageous to minimize the over-all system pressure drop by matching the rotational speed of the inlet flow 64 to the rotational speed of the separator unit 58. By "synchronizing" these speeds, the pressure drop across the separator unit 58 can be reduced and, thus, its size and weight can be lowered.

For example, consider three cases. In the first case, the separator unit 58 is stationary. In such a case, little to no acceleration (i.e., pressure) is required for the inlet flow 64 to enter the separator unit 58. In the second case, the separator unit 58 is rotating and the inlet flow 64 is rotationally stationary. In such a case, the inlet flow 64 must accelerate to match the rotational speed of the separator unit 58. The energy for this acceleration comes from the pressure in the inlet flow 64 and so the pressure of the flow inside the separator unit 58 falls a bit. This increases the pressure drop across the separator unit 58. Such a pressure drop is typically overcome by increasing the size of the separator unit 58. In the third case, assume that the inlet flow 64 is rotating about the shaft 41 at or about the same speed as the separator unit 58 is rotating. In this case, no additional energy (e.g., pressure) is required.

According to one embodiment, the inlet flow 64 can be synchronized with the separator unit 58 by a synchronizer 90 coupled to shaft 41. The synchronizer 90 imparts rotational motion to the inlet flow 64 to make it match or become closer to matching the rotational speed of the separator unit 58. That is, the synchronizer 90 can be utilized to approximate the third case described above to provide a velocity boost to bring the inlet flow 64 up to the rotational speed of the separator unit 58 without imparting flow expansion that accelerates the flow in a non-synchronized system.

Figure 3:
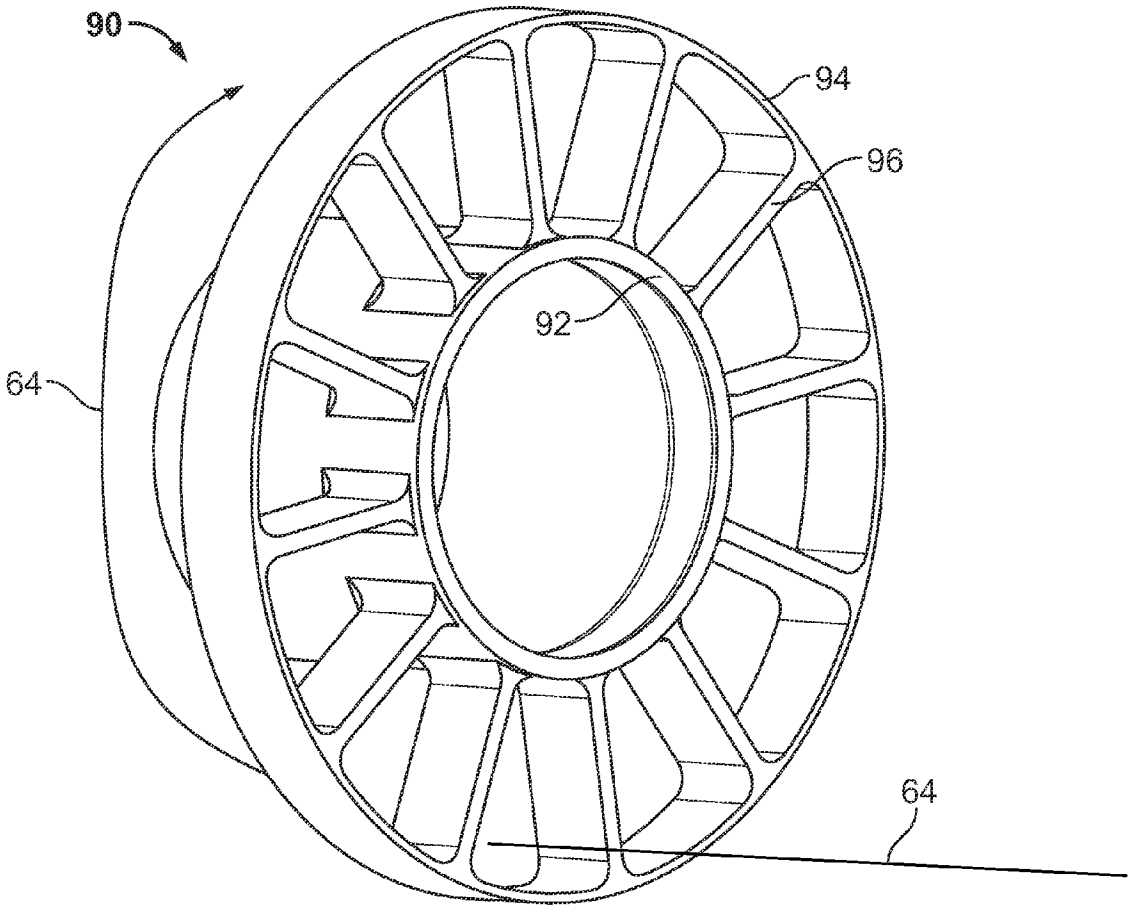
FIG. 3 is perspective view of a synchronizer according to one embodiment.

FIG. 3 is a perspective view of a synchronizer according to one embodiment. The synchronizer 90 includes inner and outer surfaces 92, 94, shown as rings, and connected to one another by one or more blades 96. The inner surface 92 can be rigidly coupled to the shaft 41 (FIG. 2) proximate the inlet ports 56 of the separator unit 58 such that rotation of the shaft 41 causes the blades 96 to impart rotational motion to inlet flow 64. Because the synchronizer 90 is rotating at the same rate as the separator unit 58 (FIG. 2), the inlet flow 64 is rotated at or about the same speed as the separator unit 58. The configuration and orientation (pitch) of the blades 96 as well as the inner and outer surfaces 92, 94 can be adjusted to suit the particular geometry of the separator unit 58 it will be associated with. In one embodiment, the outer surface 94 can be omitted. It should also be appreciated that the orientation and shape of the blades 96 could be modified. For example, the blades could be canted or otherwise pitched.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A gearbox comprising:

an inlet configured to receive a mixture of air and oil from an external source; and a deoiler, the deoiler comprising:

a shaft including an outlet passage formed on an inner portion of the shaft;

a separator unit coupled to and surrounding a portion of the shaft and including an inlet port; and a synchronizer including one or more blades and that is coupled to the shaft proximate the inlet port, wherein the synchronizer includes an inner ring and an outer ring and the blades connect the inner and outer rings.

2. The gearbox of claim 1, wherein the shaft includes one or more inner passages that fluidly connect an external portion of the shaft to the inner portion.

3. The gearbox of claim 2, wherein the separator unit surrounds the one or more inner passages and serves to remove oil from air that enters it before and to direct the air to the one more inner passages.

4. The gearbox of claim 1, wherein the blades are canted.

5. The gearbox of claim 1, wherein the external source is a bearing compartment of a turbine engine.

6. The gearbox of claim 1, further comprising:

a drive shaft coupled to a shaft of the turbine engine and to the shaft of the gearbox, the drive shaft transferring rotational power from the shaft of the turbine engine to the shaft of the gearbox thereby causing the separator unit and the synchronizer to rotate.

7. A method for removing oil from a mixture of air and oil, the method comprising:

passing the mixture through a rotating separator unit coupled to a shaft to remove the oil from the air to create exhaust air; and before passing, accelerating the mixture in a rotational direction with a synchronizer coupled to the shaft and located proximate an inlet to the rotating separator unit, wherein the synchronizer includes an inner ring and an outer ring and the blades connect the inner and outer rings.

8. The method of claim 7, further comprising:

passing the exhaust air to an interior portion of the shaft where it is exhausted to the atmosphere.

9. The method of claim 7, further comprising:

receiving the mixture from a bearing compartment of a turbine engine.

* * * * *